US006976501B1

(12) United States Patent
Pratt

(10) Patent No.: US 6,976,501 B1
(45) Date of Patent: Dec. 20, 2005

(54) APPLIANCE SURROUND STRUCTURE AND METHOD OF INSTALLATION

(76) Inventor: James M. Pratt, P.O. Box 920624, Needham, MA (US) 02492

( * ) Notice: Subject to any disclaimer, the term of this patent is extended or adjusted under 35 U.S.C. 154(b) by 61 days.

(21) Appl. No.: 10/746,642

(22) Filed: Dec. 29, 2003

(51) Int. Cl.[7] ..... D06F 35/00; B65D 6/04
(52) U.S. Cl. ..... 137/312; 137/315.01; 137/357; 220/571; 222/108
(58) Field of Search ..... 137/312, 315.01, 137/357, 360, 362; 220/571; 222/108

(56) References Cited

U.S. PATENT DOCUMENTS 5,452,739 A * 9/1995 Mustee et al. ..... 137/312
5,881,762 A * 3/1999 Janesky ..... 137/312
5,918,591 A * 7/1999 Vollmar et al. ..... 122/13.01
6,253,785 B1 * 7/2001 Shumake, Jr. et al. ..... 137/312

* cited by examiner

*Primary Examiner*—Kevin Lee
(74) *Attorney, Agent, or Firm*—William Nitkin

(57) ABSTRACT

An improved surround structure and method of installation for surrounding the base of a water-containing appliance to prevent water leakage onto a concrete floor is disclosed where a lower portion of the surround structure is embedded in the concrete floor as it is being formed and an upper portion of the surround structure extends above the basement floor to surround the base of the appliance.

9 Claims, 3 Drawing Sheets

APPLIANCE SURROUND STRUCTURE AND METHOD OF INSTALLATION

BACKGROUND OF THE INVENTION

1. Field of the Invention

The device of this invention and its method of installation reside in the field of structures for containing leakage from appliances such as hot water heaters or any other water-holding appliance and more particularly relates to a structure that surrounds the base of such appliance to retain any water leakage therein.

2. History of the Prior Art

The providing of dam-like members surrounding the base of water heaters is well known in the prior art. Such devices are generally formed by members placed around the base of a hot-water heater which members extend upwards from the ground. In some cases such members can be adhered to the floor surface in an attempt to provide a watertight enclosure to contain any water leaking from such water heater and prevent water from escaping out onto the floor area of a basement. It has been found that it is difficult to form a watertight seal between tank-surrounding structures and the floor which is usually made of concrete. Ring structures employing an epoxy sealer placed between the tank-surrounding structure and the floor are often subject to failure of such sealer, resulting in water leakage.

SUMMARY OF THE INVENTION

The device of this invention is an improved surround structure constructed of a plurality of sections which are embedded in a concrete floor as it is poured and which, because of such sealing engagement within the concrete floor, forms a watertight surround structure around the water heater or other water-containing appliance. The surround structure of this invention, when constructed and embedded in a fluid concrete floor, constitutes a significant improvement over the prior art, and the methodology of assembly and installation is simple to accomplish and greatly improves the water-retention ability of the surround structure of this invention.

DESCRIPTION OF THE PREFERRED EMBODIMENT(S)

Figure 1:
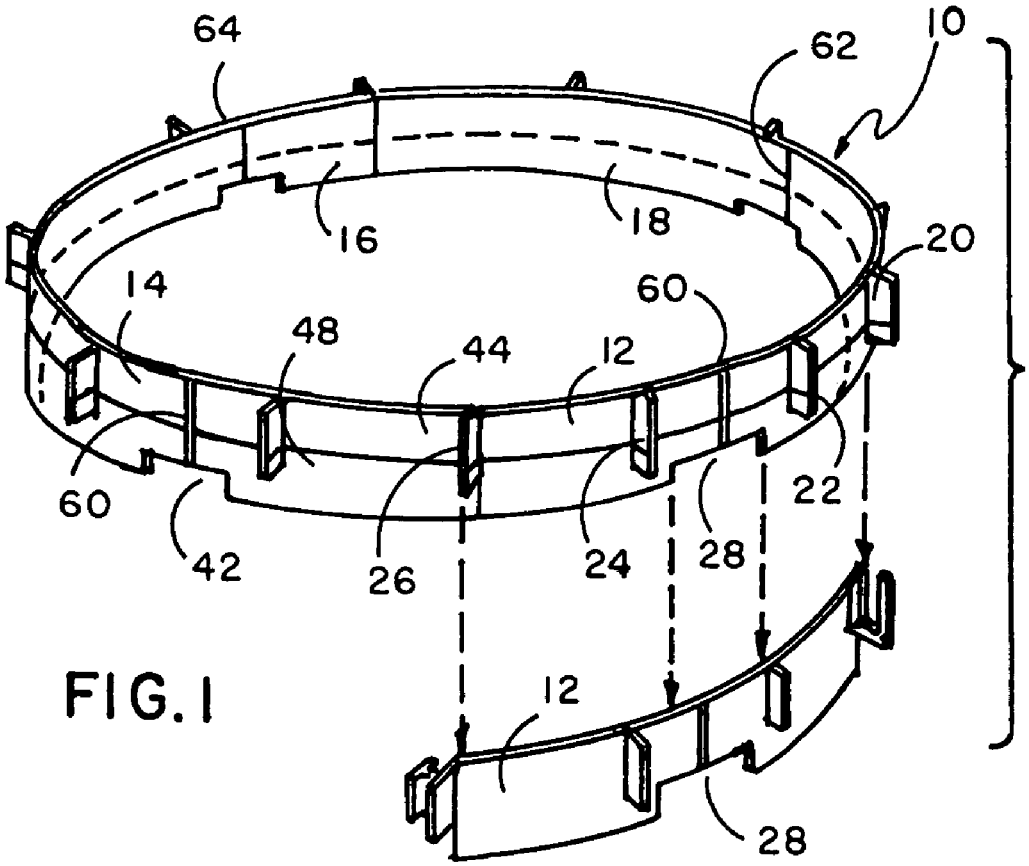
FIG. 1 illustrates a perspective view of the surround structure of this invention in the embodiment of an assembled tank ring showing one of the four sections of which it is made illustrated therebelow.

FIG. 1 illustrates a perspective view of a surround structure in the embodiment of a tank ring which is comprised of four generally curved sections which are interengaged with one another at their ends to form tank ring 10. First section 12 is seen as part of tank ring 10 and is also shown by itself below tank ring 10 for purposes of better illustration thereof. First section 12 is engaged at one end to second section 14 and to fourth section 18 at its other end. The other ends of second and fourth sections 14 and 18 are in turn engaged to the ends of third section 16, forming circular tank ring 10.

Figure 2:
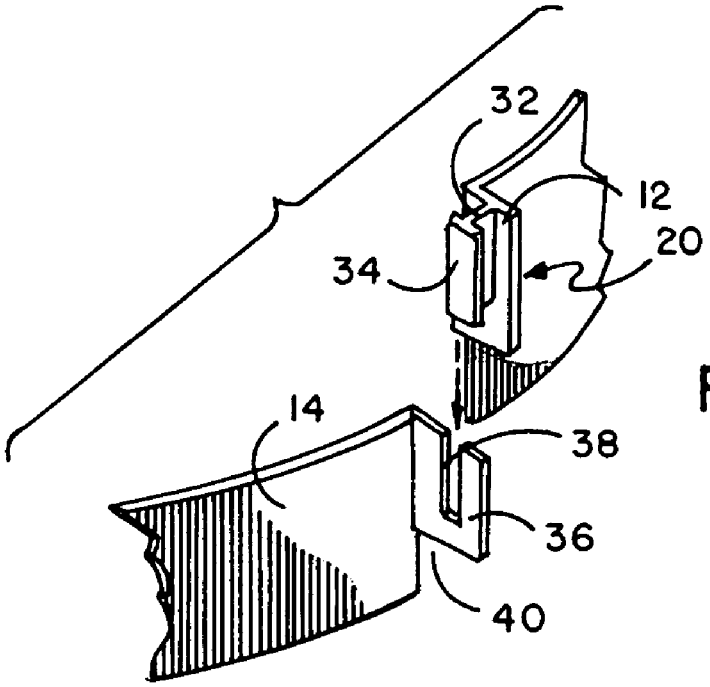
FIG. 2 illustrates a perspective view of the joining of the ends of two adjacent sections of FIG. 1.

FIG. 2 illustrates a junction between first section 12 and second section 14 wherein protruding lateral slide member 34 mounted on an extension member 32 extending from first rib side protrusion 30 of first section 12 is to be engaged into mating slot 38 formed in second rib side protrusion 36 of second section 14. The surround structure of this invention can be made of plastic or equivalent material. An adhesive can be applied so that when first rib side protrusion 30 is engaged to second rib side protrusion 36, the adhesive can form a permanent bond; and first rib side protrusion 30, being then glued to second rib side protrusion 36 would thus form protruding fourth rib 26. Other ribs are provided along the sections such as first rib 20, second rib 22 and third rib 24 on first section 12 which ribs are generally equi-spaced from one another. The ribs extend downward a distance so as to rest upon the concrete floor to be formed thereunder in floor receipt area 40. Within each section is formed an engagement notch, such as first engagement notch 28 seen in first section 12 and second engagement notch 42 seen in second section 14. Other engagement notches are centrally disposed in the bottom of each section, and such engagement notches help lock the tank ring in position when embedded in concrete flooring 54, as seen in FIG. 3.

Figure 3:
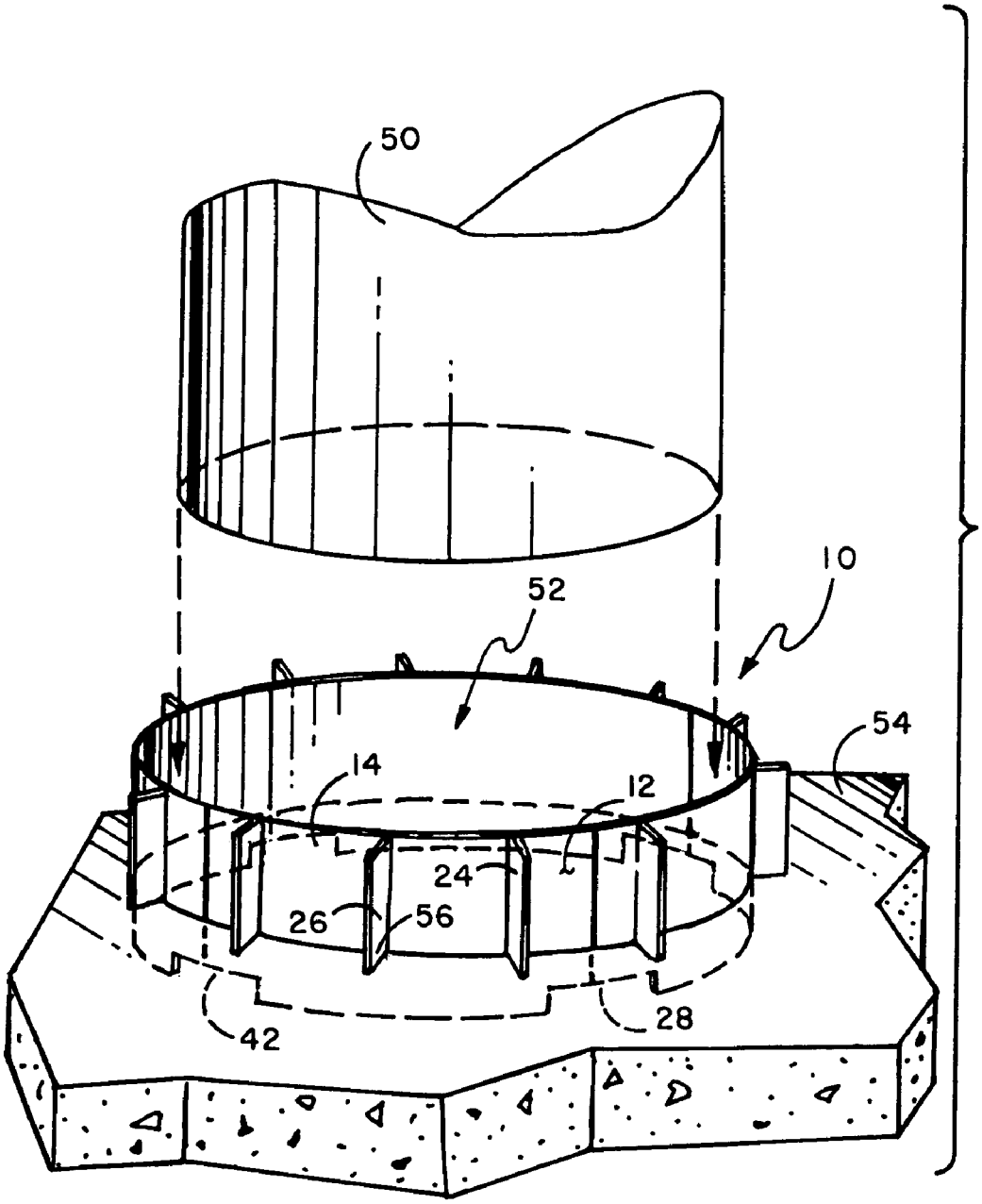
FIG. 3 illustrates a perspective view of the surround structure of this invention in the embodiment of a tank ring installed in a concrete floor.

In FIG. 3 one can see that ribs such as fourth rib 26 extends down and contacts floor 54 at contact point 56 and that the tank ring forms a heater receipt area 52, the concrete bottom of which is at the same level as basement floor 54 such that hot water heater 50 can be positioned within heater receipt area 52 and be surrounded by tank ring 10 in a manner which will prevent any leakage from within heater receipt area 52 onto basement floor 54. Because the bottom portion of tank ring 10 is embedded in the concrete as the floor is poured, a watertight engagement between the floor and tank ring 10 is achieved.

Figure 4:
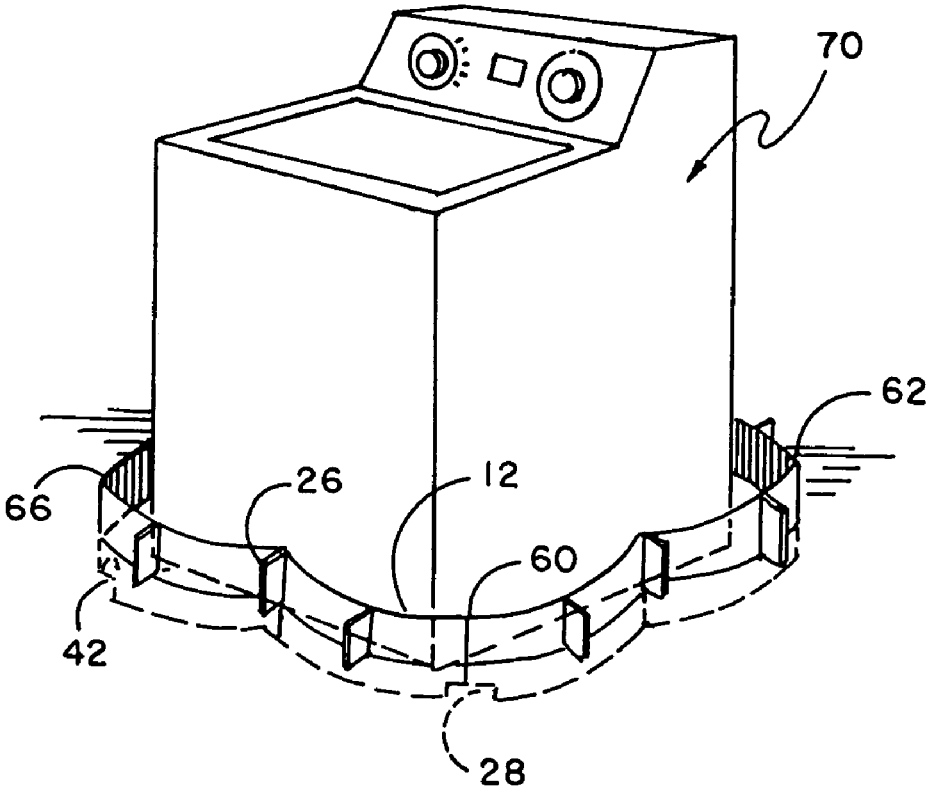
FIG. 4 illustrates a perspective view of the surround structure having a plurality of sections with each section bent along its integral live-hinge fold line for surrounding an appliance having a rectangular base.

In FIG. 4 one can see surround structure 12 disposed around a rectangular-based water-containing appliance, being a washing machine 70. In this embodiment each section is bent along an integrally formed vertical fold line, forming a live hinge such as fold lines 60, 62 and 66 seen in FIG. 4 with fold line 64 seen in FIG. 1. By bending each section on its respective fold line, one can join the sections together, as described above, so that the sections on each side of the fold line are curved, and the resulting surround structure is made of several curved sections to accommodate an appliance having a rectangular base. It should be noted that other non-rectangular shapes of appliances can be accommodated by the surround structure of this invention.

Figure 5:
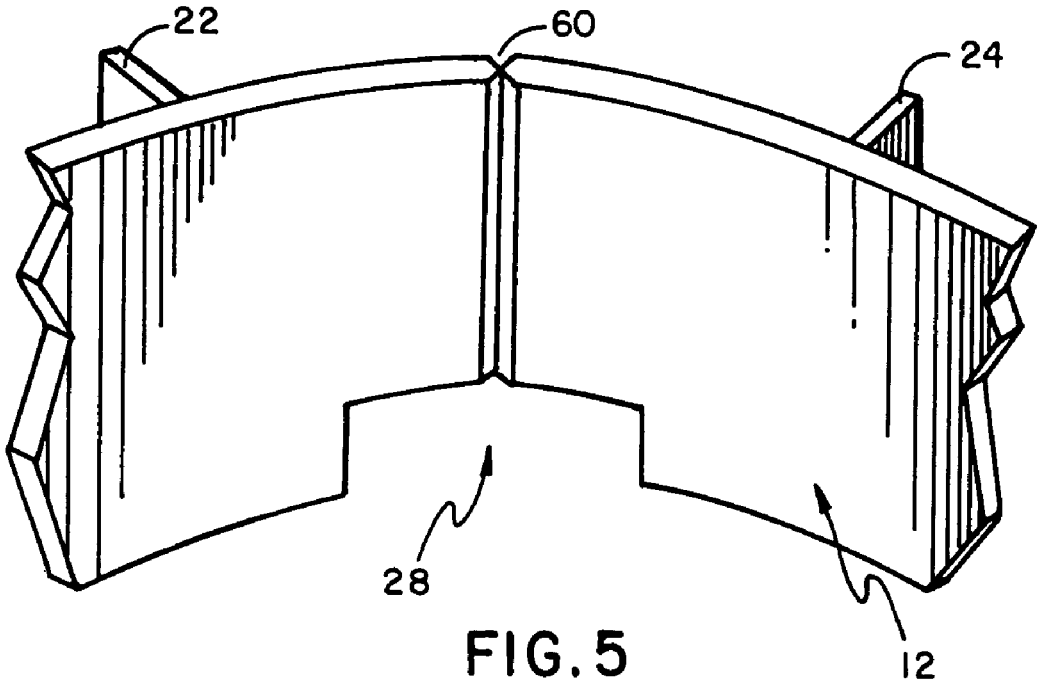
FIG. 5 illustrates a perspective view of an enlarged view of one section of FIG. 4 showing its integral live-hinge fold line.

FIG. 5 illustrates a perspective view of an enlarged portion of a section seen in FIGS. 1 and 4 with fold line 60 shown as a live hinge.

Although the present invention has been described with reference to particular embodiments, it will be apparent to those skilled in the art that variations and modifications can be substituted therefor without departing from the principles and spirit of the invention.

I claim:

1. A surround structure for surrounding a water-containing appliance disposed in an appliance receipt area of a poured concrete floor having a floor level for preventing water leakage from said appliance from contacting said concrete floor beyond said appliance receipt area, comprising:

a member having an upper portion and a lower portion, said upper portion extending above said floor level and said lower portion disposed within said poured concrete floor at the time of forming such floor such that when said concrete floor sets, said member is retained in a watertight fashion within said concrete floor and prevents water from leaking out said member onto said concrete floor beyond said appliance receipt area, wherein said member further includes:

first, second, third and fourth sections, each section having first and second ends and an upper exterior portion; and means to engage said first end of each section to the second end of its adjacent section to form said surround structure.

2. The surround structure of claim 1 further including a plurality of outwardly extending rib members, each rib member having a bottom, said rib members protruding from said upper exterior portion of each of said sections, said bottoms of said rib members adapted to rest on said poured concrete floor at floor level.

3. The surround structure of claim 2 wherein said means to engage two of said adjacent sections, when joined, forms one of said protruding rib members.

4. The surround structure of claim 3 further including an engagement notch defined in said lower portion of each of said sections for engagement in said concrete floor below said floor level.

5. The surround structure of claim 4 wherein means to engage said first end of each section to the second end of its adjacent section comprises:

a first rib side protrusion disposed at said first end of one section;

an extension member having a first end and a second end, said first end attached to said first rib side protrusion;

a lateral slide member attached to said second end of said extension member; and a second rib side protrusion disposed at said second end of said adjacent section, said second rib side protrusion having a slot defined therein adapted to receive said extension member and lateral slide member therein forming a rib member and at the same time providing for the engagement of two adjacent sections to one another.

6. The surround structure of claim 5 wherein said sections are curved.

7. The surround structure of claim 5 wherein said sections include a central integral fold line for bending thereon for shaping the surround structure to more closely conform to the base of the water-containing appliance.

8. A method of installing a surround structure around a water-containing appliance disposed in a receipt area of a concrete floor, comprising the steps of:

providing a surround structure in four separate sections, each section having an upper portion and a lower portion and first and second ends;

disposing said four separate sections aligned adjacent to one another with the first end of each section adjacent to the second end of the adjacent section around said appliance:

joining the first end of each section to the second end of an adjacent section to form said surround structure;

pouring a concrete floor having a floor level, said receipt area occupying a portion of said concrete floor;

embedding said lower portion of said surround structure around said receipt area of said concrete floor while said concrete is still fluid and leaving said upper portion of said surround structure protruding above said floor level of said concrete floor;

allowing said concrete to set around said surround structure;

permanently holding said surround structure in said receipt area; and forming a watertight seal between said surround structure around said receipt area and the remainder of said concrete floor.

9. The method of claim 8 further including, before the step of embedding said lower portion of said surround structure in said concrete floor, the steps of:

providing a central integral fold line in each section; and folding said section to match the shape of the base of said appliance.

* * * * *